United States Patent [19]

Wade

[11] Patent Number: 5,050,052

[45] Date of Patent: Sep. 17, 1991

[54] AQUATIC LAMP MOUNTING STRUCTURE

[75] Inventor: Charles E. Wade, Diamond Bar, Calif.

[73] Assignees: Wade Ventures Limited; Ann I. Hoyer, both of Diamond Bar, Calif.

[21] Appl. No.: 274,289

[22] Filed: Nov. 21, 1988

[51] Int. Cl.[5] ..... F21V 33/00

[52] U.S. Cl. ..... 362/101; 362/267; 362/145; 362/374; 439/445

[58] Field of Search ..... 362/101, 364, 365, 147, 362/267, 374, 375, 145, 368; 439/445, 446, 470, 473, 564

[56] References Cited

U.S. PATENT DOCUMENTS

| | | | |
|---|---|---|---|
| 1,817,004 | 8/1931 | Hubbell, Jr. | 439/446 X |
| 1,909,404 | 5/1933 | Horn | 362/101 |
| 2,742,624 | 4/1956 | Stevens, Jr. | 439/564 X |
| 3,622,943 | 11/1971 | Reimer | 439/472 |
| 3,962,675 | 6/1976 | Rowley et al. | 362/101 |
| 4,259,710 | 3/1981 | Schlack | 362/267 |
| 4,360,859 | 11/1982 | Ziaylek, Jr. | 362/267 X |
| 4,433,366 | 2/1984 | Wade | 362/267 |
| 4,460,944 | 7/1984 | Gordbegli et al. | 362/101 X |
| 4,475,147 | 10/1984 | Kristofek | 362/364 X |
| 4,574,337 | 3/1986 | Poppenheimer | 362/267 |

FOREIGN PATENT DOCUMENTS

| | | | |
|---|---|---|---|
| 959196 | 9/1982 | U.S.S.R. | 439/445 |

OTHER PUBLICATIONS

IBM Disclosure Bulletin, "Double Angle Strain Relief Clamp", vol. 3, No. 6, Nov. 1960, pp. 4 & 5.

*Primary Examiner*—Ira S. Lazarus
*Assistant Examiner*—D. M. Cox
*Attorney, Agent, or Firm*—Boniard I. Brown

[57] ABSTRACT

A light assembly for installation in an aquatic facility such as a swimming pool, fountain or the like. The light assembly has a watertight lamp housing mounted within a generally cup-like mounting box to be installed within a wall recess or opening in the aquatic facility. Both the mounting box and the lamp housing have body shells which are tapered for stacking during manufacture, storage, and installation. The mounting box has a coupling which is adapted for connection to an electrical conduit containing an electrical cable that conducts electrical power to the lamp housing and which is adjustable to accommodate a range of orientations of the conduit relative to the box. The body of the lamp housing has a unique one piece shell construction including an integrally formed main body portion and face ring which greatly simplifies and reduces the manufacturing cost of the housing.

17 Claims, 2 Drawing Sheets

AQUATIC LAMP MOUNTING STRUCTURE

BACKGROUND OF THE INVENTION

1. Field of the Invention

This invention relates generally to illumination devices and more particularly to an improved aquatic light assembly for underwater installation in aquatic pools, fountains, and the like.

2. Discussion of the Prior Art

Most if not all swimming pools and many other aquatic pools, fountains and the like are equipped with underwater lights for providing illumination at night. In the case of swimming pools, the lights serve the dual function of providing the illumination necessary for convenient and safe nightime use of the pools and providing the pools with a highly ascetic nightime appearance. The underwater lights of other aquatic pools, fountains, and the like provide only ascetic illumination. All such aquatic lights, however, have certain common structural requirements which result from their underwater installation.

A typical aquatic light assembly has a watertight lamp housing to be installed within an opening or recess in the pool wall below the normal water level in the pool. This lamp housing contains an electrical receptacle for receiving a light bulb or lamp and has a front transparent lens which passes light from the lamp to the exterior of the lamp housing. The lamp housing is mounted within the pool wall recess or opening with the front lens of the housing generally flush with the wall. Many aquatic light installations of this kind also include a shell-like mounting box which is permanently placed within the pool wall opening or recess and is sized and shaped to removable receive the lamp housing. This mounting box has an open front end thru which the light housing is insertable into and removable from the mounting box. The lamp housing is releasibly secured within the mounting box. Electrical power is delivered to the lamp receptacle within lamp housing thru a waterproof electrical cable which extends thru the mounting box and is sealed to the lamp housing. The cable leading to the mounting box is commonly contained within an electrical conduit which is threaded into a coupling on the mounting box. A sufficient length of cable is provided within the mounting box to permit removal of the lamp housing thru the open front end of the mounting box. The prior aquatic lights are designed for installation in both traditional concrete or Gunite pools and vinyl lined steel walled pools.

My prior U.S. Pat. No. 4,433,366 discloses an underwater aquatic light assembly of the character described. The lamp housing of this prior aquatic light assembly has a body comprising three separately formed parts which are a rear housing shell having a front end opening surrounded by a tapered front flange on the housing shell, a face ring having an inner tapered circumferential flange facing the front housing shell flange, and a radially contractable coupling ring having an inner tapered groove receiving the housing shell and face ring flanges. The perimeter of the lens fits within a groove in a seal ring which is disposed within the coupling ring between the housing shell and face ring flanges. The coupling ring is radially contracted to firmly join the housing shell, face ring, and lens into a rigid unit and seal these parts to one another to form a watertight lamp housing.

The aquatic light assembly of my prior patent also includes a mounting box for permanent installation within an opening or recess in an aquatic pool wall. The watertight lamp housing is removably secured within this mounting box with the face ring of the lamp housing projecting radially out from the housing for seating contact with the front end of the mounting box or with the pool wall.

SUMMARY OF THE INVENTION

This invention provides an improved aquatic aquatic light assembly of the general class described. According to one of its aspects, the invention provides a novel one piece unitary body for the watertight lamp housing of the aquatic light assembly. This housing body comprises a one piece shell including a rear cup-like portion and a front face ring integrally joined to the front end of the rear shell portion. The rear portion of the body shell forms the main body of the lamp housing and mounts a receptacle for receiving the lamp of the aquatic light assembly. The front face ring has a rearwardly facing, circumferential seating surface. The body shell has a front end opening spanned by a transparent lens. The lens is releasibly secured to the lamp housing and is sealed to the housing by a seal ring disposed between the perimeter of the lens and sealing surfaces on the shell.

In the preferred embodiments of the invention, the rear body portion of the lamp housing shell is tapered to permit compact stacking of a number of the housings during fabrication, storage, and installation of the aquatic light assemblies. The front end of the housing shell is radially outwardly stepped or offset to form a forwardly and inwardly opening recess which receives the perimeter of the lens and forms with the lens perimeter an annular cavity containing the seal ring for sealing the lens to the shell. Forwardly of this lens recess is a second recess receiving a lock ring for securing the lens to the housing shell with the lens sealed to the housing to provide with the shell a watertight lamp housing.

According to another aspect of the invention, the aquatic light assembly includes an improved mounting box for the lamp housing. This mounting box comprises a shell open at its front end and mounting a novel adjustable rear coupling for engagement with the electrical conduit which contains the electrical cable for conducting electrical power to the aquatic light assembly. This coupling is uniquely shaped and arranged for adjustable attachment to the mounting box in a manner which permits adjustment of the coupling relative to the mounting box to accomodate a range of orientations of the conduit relative to the mounting box.

The mounting box is permanently installed in the wall of a pool with the open front end of the mounting box opening to the pool. The pool may be either a traditional concrete or Gunite pool, in which case the mounting box is installed within a recess in the pool wall, or a vinyl covered rigid-walled pool, in which case the mounting box is installed within an opening in the wall. The improved lamp housing of the invention is inserted into this mounting box thru its open front end to a position where the rear seating surface of the lamp housing face ring seats either directly against the pool wall or against the front end of the mounting box.

DESCRIPTION OF THE PREFERRED EMBODIMENTS

Figure 1:
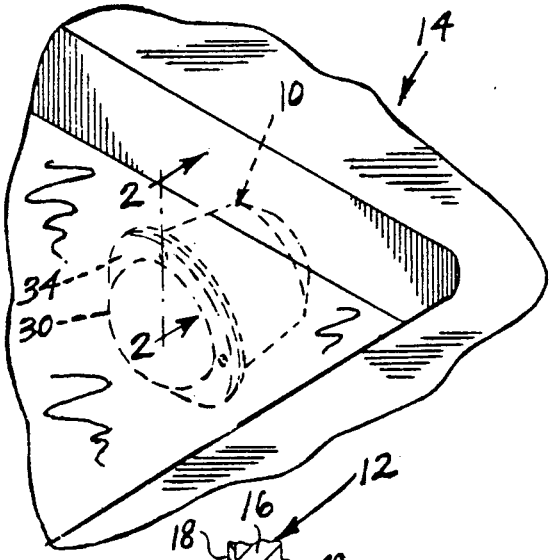
FIG. 1 is a fragmentary perspective view of a vinyl-lined steel walled aquatic pool containing an improved aquatic light assembly according to the invention.
Figure 5:
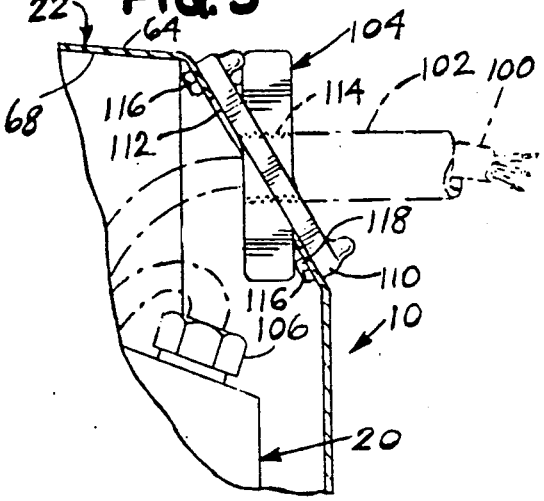
FIG. 5 is an enlarged section taken on line 5—5 in FIG. 4.

Turning now to these drawings and first to FIGS. 1-5, there is illustrated an improved aquatic aquatic light assembly 10 according to the invention installed in the wall 12 of a swimming pool 14. The particular pool wall shown is a vinyl-covered wall including a steel wall member 16 covered with a vinyl layer 18. The improved aquatic light assembly 10 includes a watertight lamp housing 20 removably mounted within a mounting box 22 to be permanently installed within an opening 24 in the pool wall 12.

The improved lamp housing 20 of the aquatic light assembly 10 comprises a novel one-piece body 26 in the form of a shell with a front end opening 28, and a transparent lens 30 spanning the opening 28. The lens is secured and sealed to the housing shell 26 to form with the shell a watertight lamp housing. The housing shell 26 includes a rear, generally cup-like portion 32 and a front face ring 34. The rear shell portion 32 has a circumferential side wall 36 with front and rear ends and a rear wall 38 integrally joined about its perimeter to the rear end of the side wall to close the rear end of the housing shell. The front end of the housing shell 32 is radially outwardly offset or stepped to form a forwardly and inwardly opening seal ring recess 42 circumferentially surrounding the front housing opening 28 and bounded by surfaces 44, 45. Forwardly of the recess 42 is a lock ring recess 46.

Figure 2:
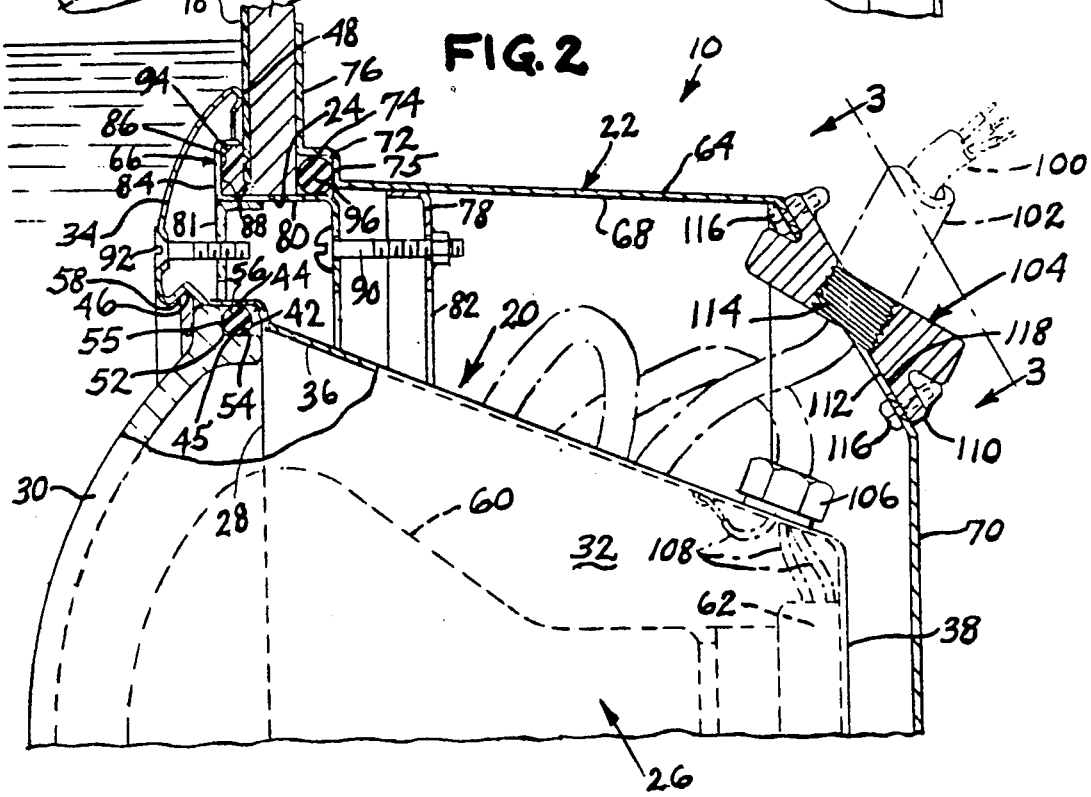
FIG. 2 is an enlarged section through the aquatic light assembly taken in a longitudinal plane of the light.
Figure 3:
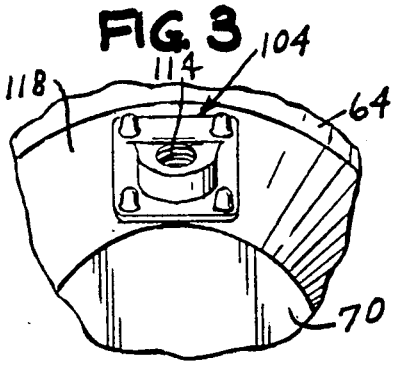
FIG. 3 is a view taken on line 3—3 in FIG. 2 and illustrating the rear conduit coupling of the aquatic light assembly mounting box in one position of adjustment.
Figure 4:
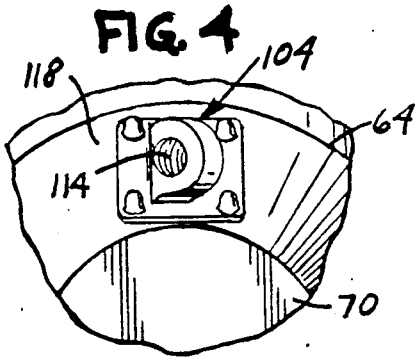
FIG. 4 is a view similar to FIG. 3 illustrating the coupling in another position of adjustment.

The housing shell face ring 34 is coaxial with the rear shell portion 32 and is integrally joined to the front end of the shell side wall 36 forwardly of the seal ring and lock ring recesses 42, 46. The face ring extends laterally outward from the housing shell side wall and curves rearwardly in longitudinal cross-section, as shown in FIG. 2. The outer perimeter of the face ring is turned radially inward, also as also shown in FIG. 2, to form a rear, rearwardly facing seating surface 48 about the ring perimeter.

The unitary one piece lamp housing body or shell 26 including its rear body portion 32 and front face ring 34 may be fabricated in any convenient way from sheet metal or plastic and constitutes an important feature of the invention which greatly simplifies and reduces the fabrication cost of the aquatic light assembly.

The perimeter of the lens 30 engages within the housing shell seal ring recess 42. Formed in the lens perimeter is an outwardly and rearwardly opening circumferential seal ring recess 52 bounded by surfaces 54, 55. These lens surfaces 54 form with the shell recess surfaces 44, 45 an annular cavity 54 containing a captivated seal ring 56. The lens 30 is releasibly secured to the lamp housing 26 by a snap lock ring 58 engaged within the lock ring recess 46. The seal ring 56 is compressed between the sealing surfaces 44, 54, as shown in FIG. 2, to form a watertight seal between the housing shell 26 and the lens 30 and thereby provide a watertight lamp housing or enclosure 20 for containing a lamp 60. Mounted on the rear wall 38 of the lamp housing 26 is an electrical receptacle 62 for receiving the base of the lamp 60.

The mounting box 22 of the aquatic light assembly 10 includes a rear, generally cup-like cylindrical shell 64 and a front clamp ring 66. The rear shell 64 has a tapered side wall 68 and a rear wall 70. The front end of the shell side wall 68 is radially outwardly stepped and turned to form about the open front end of the shell 64 a forwardly and inwardly opening seal ring recess 72 bounded by sealing surfaces 74, 75 and a front annular flange 76 disposed in a transverse plane of the shell. Rigidly fixed within the shell 64 adjacent its open front end is an annular flange 78. The mounting box shell wall is tapered, as shown, to permit a number of the lamp housings to be stacked in the manner shown in FIG. 7 during fabrication, storage, and installation of the aquatic light assemblies.

The clamp ring 66 of the mounting box 22 includes a central cylindrical portion 80, front and rear radially inwardly projecting annular flanges 81, 82, and a front radially outwardly and rearwardly projecting flange 84. The outer diameter of the central clamp ring portion 80 approximates or is slightly less than the inner diameter of the box shell side wall 68. The front clamp ring flange 84 forms a seal ring recess 86 bounded by sealing surfaces 88. The clamp ring 66 is secured to the mounting box shell 64 by screws 90 (FIG. 2).

The lamp housing 20 is coaxially disposed within the mounting box 22 with the front end of the housing projecting fowardly thru the open front end of the box. The housing face ring 34 extends radially outward across the front end of the box to a position where the face ring seating surface 48 is situated radially outward of the front flange 84 of the box clamp ring 66. The lamp housing 20 is secured to the mounting box 22 by screws 92 (FIG. 2) which extend thru the housing face ring 34 and the flange 81 within the front end of the box clamp ring 66. The mounting box recesses 72, 86 contain seal rings 94, 96.

As noted earlier and shown in FIG. 2, the aquatic light assembly 10 is mounted within an opening 24 in the pool wall 12. In this case, the pool wall comprises a rigid wall member 16 covered with a vinyl liner 18. The light assembly is installed in the opening in the following manner. The lamp housing 20 is removed from the mounting box 22 by removing the light housing mounting screws 92. The mounting box clamp ring 66 is separated from the mounting box shell 64 by removing the clamp ring screws 90. The shell 64 is placed outside of the pool wall 12 with the shell flange 76 and seal ring 86 seating against the outer wall surface about the wall opening 24. The mounting box clamp ring 66 is inserted thru the wall opening 24 from the inner side of the pool wall 12 to engage the clamp ring seal ring 94 with the inner wall side and locate the central lock ring portion 80 within the opening. The opening is sized to receive the central clamp ring portion 80 with a close fit. The mounting box shell 64 and clamp ring 66 are rejoined by the screws 90 which are then tightened to draw the shell flange 76 and outer clamp ring flange 84 toward one another until the pool wall 12 is firmly gripped between these flanges to rigidly secure the mounting box 22 to the wall and the box seal rings 94, 96 are compressed against the wall to seal the mounting box to the wall about the wall opening 24. The seal ring 96 also contacts the mounting box surface 74 and the central clamp ring portion 80 to seal the clamp ring 66 to the mounting box shell 64. The seal rings 94, 96 seal the mounting box 22 to the pool wall 16 to prevent water leakage from the pool to the surrounding soil.

After this installation of the mounting box 22 in the pool wall opening 24, the lamp housing 20 is inserted into the box thru its open front end. The lamp housing is then rejoined to the mounting box by the screws 92 which are tightened to press the rear seating surface 48 on the housing face ring 34 firmly against the inner surface of the pool wall 12.

It is significant to note that since the seal ring 56 is compressed radially between the lamp housing and lens surfaces 44, 54, the seal ring is effective to seal the lens to the lamp housing 20 simply by assemblying the lens in the housing and without the necessity of applying an axial clamping force between the lens and housing. In this regard, it will be observed that the snap ring 58 simply restrains the lens 30 against separation from the lamp housing 20 and does not exert an axial clamping force on the lens.

Similarly, the seal ring 96 is effective to seal the mounting box 22 to the clamp ring 66 simply by assemblying the box and ring and without the necessity or precisely coaxially aligning the box and ring or applying an axial clamping force between the box and ring. This is an advantage if the shape or condition of the pool wall 16 is such as to preclude effective sealing contact of the seal ring 96 with the wall and/or precise coaxial alignment of the mounting box and clamp ring when the clamp ring seal 94 is clamped against the inner surface of the wall. Under these conditions, the seal ring 96 will still seal the mounting box 22 to the clamp ring 66 to prevent water leakage from the pool to the surrounding soil.

Electrical power is fed to the lamp housing 20 thru an electrical cable 100. This cable extends to the lamp housing mounting box 22 thru a tubular electrical conduit 102. The mounting box end of this conduit is threaded in a coupling 104 secured to rear end of the mounting box shell 64. As will be described presently, this coupling is uniquely constructed in accordance with this invention for adjustment to accommodate a range of orientations of the conduit 102 relative to the mounting box. The cable 100 extends from the conduit 102, thru the mounting box 22, to a coupling 106 secured to the lamp housing shell which provides a water-tight seal between the cable and the shell. The electrical leads 108 of the cable connect to the terminals of the lamp receptacle 62 within the lamp housing 20. A sufficient slack length of the cable 100 is provided within the mounting box 22 to permit removal of the lamp housing 20 from the box for connection and disconnection of the cable to and from the lamp housing.

As mentioned above, another important aspect of the invention is concerned with the coupling 104 for connecting the cable conduit 102 to the mounting box 22. As shown best in FIGS. 2–5, this coupling includes a mounting flange 110 having at one side a mounting surface 112, and a threaded bore 114 extending thru the flange at an oblique angle to the mounting surface for threadedly receiving the conduit 102. The mounting flange 110 is secured to the rear end of the mounting box shell 64 by bolts 116. As depicted in FIGS. 2–5, the bolts 116 are spaced about the coupling flange 110 in such a way that the coupling 104 may be secured to the mounting box shell in different angular positions, thereby to effectively angularly adjust the axis of the coupling bore 114 to accommodate different orientatitons of the cable conduit 102 relative to the mounting box 22. In the particular embodiment illustrated, for example, the coupling 104 is secured to an oblique surface 118 of the box shell 64 and is adjustable to accommodate an inclined conduit 102 in FIGS. 2 and 3 and a generally horizontal conduit in FIGS. 4 and 5.

Figure 6:
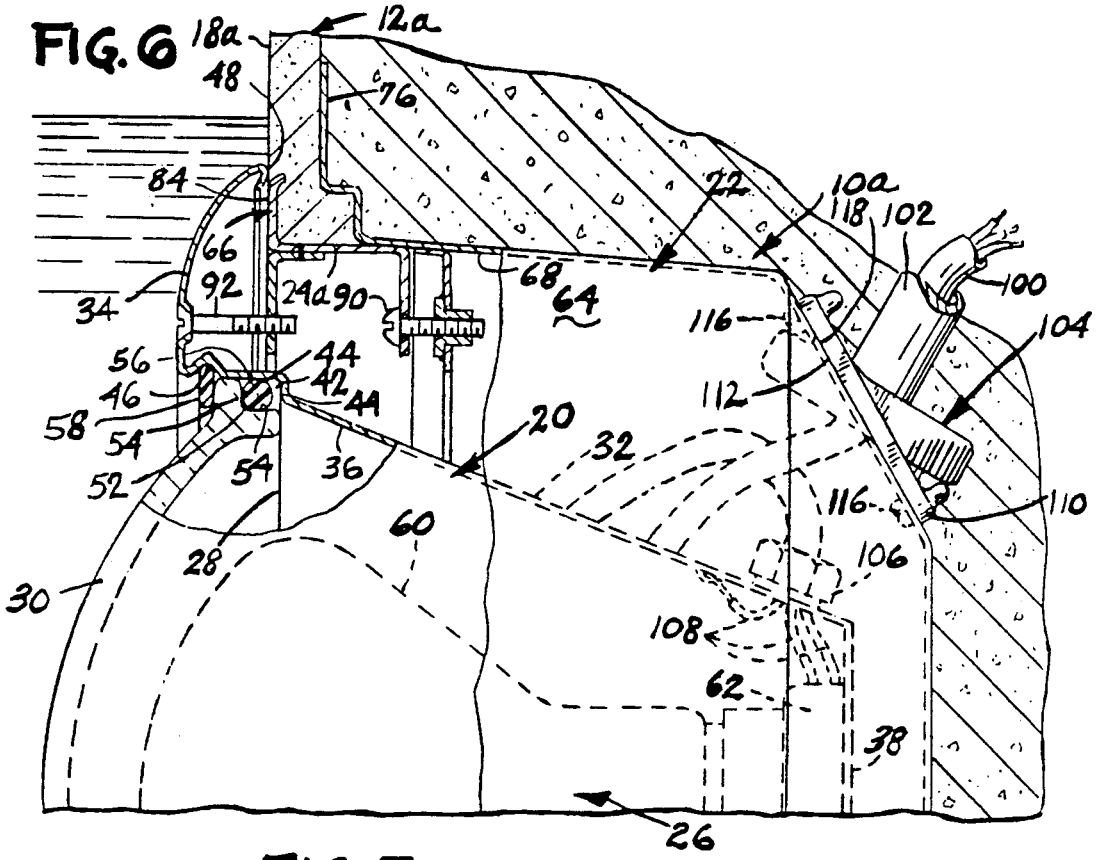
FIG. 6 is a section through a modified aquatic light assembly according to the invention installed in a traditional concrete or Gunite pool.
Figure 7:
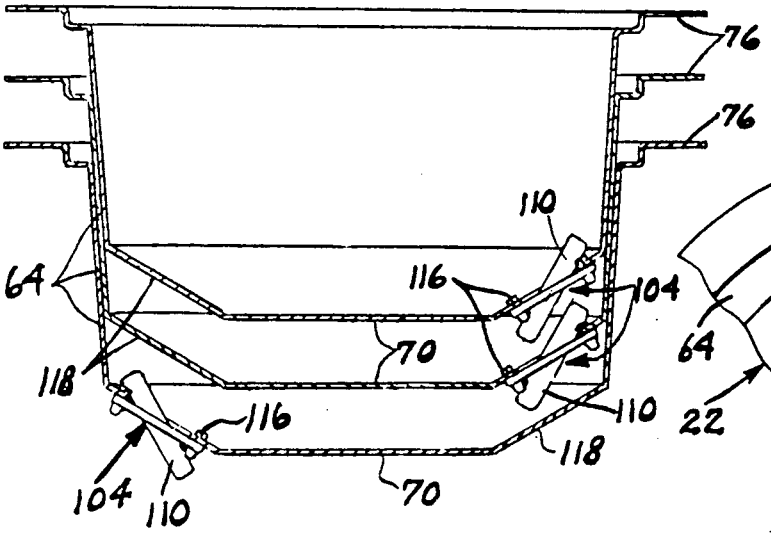
FIG. 7 illustrates the manner in which a number of the improved aquatic light assembly mounting boxes of the invention may be stacked.
Figure 8:
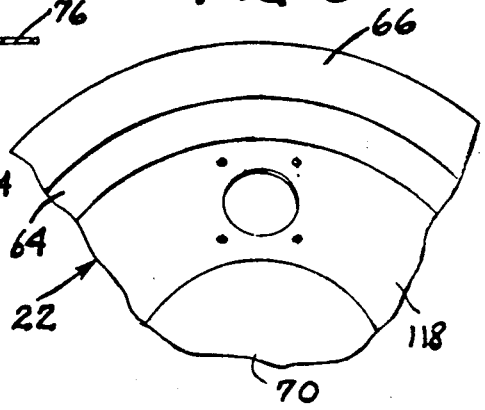
FIG. 8 is a fragmentary view of the rear portion of the mounting box of FIG. 6, showing openings to accommodate the rear conduit coupling and fasteners for securing the same.

The modified aquatic light assembly **10*a* of FIG. 7 is designed for installation in a wall recess 24*a* of a concrete or Gunite pool. This modified light assembly is identical to that of FIGS. 1–5 except as follows. The mounting box seal rings 94, 96 in FIGS. 1–5 are omitted in FIG. 6. The mounting box 22 is disposed with the front flange 66 of the box shell 64 in contact with the outer side of the inner pool wall layer 18*a* and with the clamp ring flange 84 in contact with the inner side of the wall layer 18*a* so that the wall layer is gripped between the flanges. The outer projecting portion of the mounting box shell 64 is encased in the outer concrete of the pool wall 12*a*. The lamp housing face ring 34 seats against the inner side of the inner wall layer 18*a***.

Thus there has been shown and described a novel aquatic lamp mounting structure which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A lamp housing body for a water-tight aquatic light, comprising:

a one piece relatively thin-walled shell having a front end opening for containing a transparent lens and including a circumferential side wall having front and rear ends and a front end portion circumferentially surrounding said front end opening, a rear end wall integrally joined to the rear end of said side wall, and a face ring about and integrally joined to the front end of said side wall, and wherein said front end portion of said shell side wall is radially outwardly stepped to form an inner, forwardly and radially inwardly opening annular recess surrounding said front end opening rearwardly of said front end of said shell side wall for receiving the perimeter of a lens positioned in said opening and a seal ring for sealing the lens to said shell, said recess has a forwardly facing, annular rear wall surface disposed in a transverse plane of said shell and a radially inwardly facing circumferential wall surface extending forwardly from said rear wall surface to the front end of said shell side wall, said face ring projects radially out from the front end of said shell side wall and has a rear seating surface about its perimeter, and said face ring is devoid of any projection radially inward beyond said circumferential wall surface which obstructs placement of a lens in and removal of a lens from said shell front end opening.

2. A lamp housing body according to claim 1 wherein:

said front end portion of said shell side wall contains a circumferential, radially inwardly opening lock-ring-receiving recess in said circumferential wall surface between said rear wall surface and said face ring.

3. A watertight aquatic lamp housing comprising:

a relatively thin-walled shell having a front end opening for containing a transparent lens and including a circumferential side wall having front and rear ends and a rear end wall joined to the rear end of said side wall, said front end portion of said shell side wall being radially outwardly stepped to form an inner, forwardly and radially inwardly opening annular recess surrounding said front end opening rearwardly of said front end of said shell side wall and having a forwardly facing annular rear wall surface disposed in a transverse plane of said shell and a radially inwardly facing circumferential wall surface extending forwardly from said rear wall surface to the front end of said shell side wall, a transparent lens positioned within said shell front end opening with the lens perimeter seating in said recess, said lens having about its perimeter a rearwardly and radially outwardly opening recess bounded by an annular front wall surface facing rearwardly toward said shell recess rear wall surface and a circumferential wall surface facing radially outward toward said shell recess circumferential surface, and said shell and lens recesses forming an annular seal ring cavity about said front end opening, a lock ring releasibly engaging in a lock ring recess in said circumferential surface forwardly of said lens releasibly securing said lens to said shell and constituting the sole obstruction to installation of said lens in and removal of the lens from said front end opening, and a seal ring within said seal ring cavity engaging said circumferential wall surfaces of said shell and lens for sealing the perimeter of said lens to said shell.

4. A lamp housing according to claim 3 wherein:

said shell includes a face ring integrally joined to the front end of said shell side wall forwardly of said lock ring recess.

5. A lamp housing according to claim 4, wherein:

said lamp housing body includes a face ring integrally joined to and extending radially out from the front end of said shell side wall forwardly of said lock ring recess and devoid of any projection radially inward of said circumferential wall surface of said shell which obstructs placement of said lens in and removal of the lens from said shell front end opening.

6. An aquatic light assembly comprising:

a mounting box comprising a cup-like shell having an open front end, and an outer circumferential flange about and projecting radially outwardly from the front end of said mounting box shell, a watertight lamp housing within said mounting box comprising a one piece relatively thin-walled shell having a front end opening for containing a transparent lens and including a circumferential side wall having front and rear ends and a front end portion circumferentially surrounding said front end opening, a rear end wall integrally joined to the rear end of said side wall, and a face ring about and integrally joined to the front end of said side wall and projecting radially outward from said side wall forwardly of and across the front end of said mounting box and said mounting box flange, said front end portion of said lamp housing shell side wall being radially outwardly stepped to form an inner, forwardly and radially inwardly opening annular recess surrounding said front end opening rearwardly of said front end of said shell side wall and having a forwardly facing annular rear wall surface disposed in a transverse plane of said shell and a radially inwardly facing circumferential wall surface extending forwardly from said rear wall surface to the front end of said shell side wall, a transparent lens positioned within said housing shell front end opening with the lens perimeter seating in said recess, said face ring being devoid of any projection radially inward beyond said shell circumferential wall surface which obstructs placement of said lens within and removal of said lens from said shell front end opening, means releasibly securing said lens to said lamp housing shell, means sealing said lens to said lamp housing shell, and means releasibly joining said lamp housing face ring and mounting box.

7. A light assembly according to claim 6 wherein:

said mounting box further comorises a mounting box flange about the open front end of said mounting box shell, a clamp ring having a flange coaxially disposed between said lamp housing face ring and said mounting box flange, and said means joining said face ring and mounting box comprise screws joining said face ring and clamp ring and other screws joining said clamp ring and mounting box shell.

8. A light assembly according to claim 6, wherein:

said lens has about its perimeter a rearwardly and radially outwardly opening recess bounded by an annular front wall surface facing rearwardly toward said rear wall surface of said lamp housing recess and a circumferential wall surface facing radially outward toward said circumferential wall surface of said lamp housing recess, said lamp housing and lens recesses from an annular seal ring cavity about said lamp housing front end opening, said sealing means comprises a seal ring within said cavity engaging said circumferential wall surfaces of said lamp housing and lens recesses, and said means securing said lens to said lamp housing shell comprises a lock ring engaging in a lock ring recess in said circumferential wall surface of said lamp housing recess forwardly of said lens.

9. A light according to claim 6, wherein:

said mounting box includes a clamp ring having a cylindrical portion coaxially disposed within the open front end of said mounting box shell, and an outer circumferential flange about and extending radially outward from the front end of said clamp ring cylindrical portion between said mounting box shell flange and said lamp housing face ring, said mounting box shell includes a circumferential side wall having a radially offset front end portion forming a forwardly and radially inwardly opening circumferential recess about the open front end of the mounting box shell rearwardly of said mounting box flange and bounded by an annular rear wall surface facing forwardly toward said clamp ring flange and a circumferential surface extending forwardly from said latter rear wall surface to the front end of said mounting box shell and facing radially inward toward said clamp ring central portion, a seal ring within said mounting box recess engaging said circumferential wall surface of said mounting box recess and said clamp ring cylindrical portion, and said means releasibly joining said lamp housing and said mounting box shell comprise first screws joining said lamp housing face ring and said clamp ring, and second screws joining said clamp ring and said mounting box shell.

10. A light assembly according to claim 9, wherein:

said lens has about its perimeter a rearwardly and radially outwardly opening recess bounded by an annular front wall surface facing rearwardly toward said rear wall surface of said lamp housing recess and a circumferential wall surface facing radially outward toward said circumferential wall surface of said lamp housing recess, said lamp housing and lens recesses form an annular seal ring cavity about said lamp housing front end opening, said sealing means comprises a seal ring within said cavity engaging said circumferential wall surfaces of said lamp housing and lens recesses, and said means securing said lens to said lamp housing shell comprises a lock ring engaging in a lock ring recess in said circumferential wall surface of said lamp housing recess forwardly of said lens.

11. A light assembly according to claim 10, wherein:

said mounting box shell and said clamp ring have internal flanges, said first screws extend between said face ring and an internal clamp ring flange, and said second screws extend between an internal clamp ring flange and an internal mounting box flange.

12. An aquatic light assembly comprising:

a mounting box comprising a cup-like shell having an open front end, a watertight lamp housing within said mounting box comprising a generally cup-like shell having an open front end containing a front end opening and a closed rear end and including a circumferential side wall having a front end surrounding said said housing front end opening and an opposite rear end, a rear end wall integrally joined to the rear end of said side wall, and a face ring about and integrally joined to the front end of said side wall and projecting radially outward from said side wall forwardly of and across the front end of said mounting box, an electrical receptacle mounted within said housing shell on said housing shell rear end wall for receiving a light bulb, a transparent lens positioned within said housing shell front end opening, means securing said lens to said housing shell, and means sealing said lens to said housing shell, means releasibly joining said lamp housing and mounting box, and wherein said mounting box further comprises a seal ring about the open front end of said mounting box shell, a clamp ring coaxially disposed opposite the open front end of said mounting box shell including a seal ring, and means joining said mounting box shell and clamp ring for moving said box shell and clamp ring and thereby their seal rings toward one another, said mounting box shell includes a circumferential side wall having a radially offset front end portion forming a forwardly and inwardly opening circumferential recess about the open front end of the box shell receiving the seal ring on said mounting box shell, and an inner circumferential flange within said mounting box shell rearwardly of said side box shell recess, said mounting box clamp ring includes a central cylindrical portion coaxially disposed within the open front end of said mounting box shell, an outer circumferential flange about said clamp ring central portion forming a rearwardly opening recess receiving said clamp ring seal ring, and inner circumferential flange means about the inside of said clamp ring central portion, said means joining said mounting box clamp ring and shell comprise screws extending thru said inner clamp ring flange means and said inner mounting box flange, and said means releasibly joining said lamp housing and mounting box comprise screws extending thru said lamp housing face ring and said inner clamp ring flange means for drawing said outer mounting box flange and said face ring toward one another.

13. An aquatic light assembly comprising:

a mounting box comprising a cup-like shell having an open front end, a watertight lamp housing within said mounting box comprising a generally cup-like shell having an open front end containing a front end opening and a closed rear end and including a circumferential side wall having a front end surrounding said housing front end opening and an opposite rear end, a rear end wall integrally joined to the rear end of said side wall, and a face ring about and integrally joined to the front end of said side wall and projecting radially outward from said side wall forwardly of and across the front end of said mounting box, an electrical receptacle mounted within said housing shell on said housing shell rear end wall for receiving a light bulb, a transparent lens positioned within said housing shell front end opening, means securing said lens to said housing shell, and means sealing said lens to said housing shell, means releasibly joining said lamp housing and mounting box, and wherein said mounting box includes a rear coupling having a threaded bore to receive a threaded end of an electrical conduit containing an electrical cable for conducting electrical power to said lamp housing receptacle, and said coupling is adjustable to vary the angle of the axis of said threaded bore relative to said mounting box shell, said mounting box shell has a rear mounting surface for said coupling containing a cable opening through which may pass an electrical cable extending through a conduit threaded in said coupling bore, said coupling has a mounting surface through which one end of said coupling bore opens and which is disposed at an oblique angle relative to said axis of said coupling bore, said coupling is disposed with its coupling surface in contact with said mounting surface and with said one end of said coupling bore aligned with said cable opening, and the coupling is rotatable about the axis of said cable opening to vary the angle of said coupling bore relative to said mounting box, and means for releasibly securing said coupling to said mounting surface in different angular positions about the axis of said cable opening.

14. A mounting box for an aquatic light comprising:

a generally cup-like shell having a front end opening and including a circumferential side wall having a radially outwardly stepped portion forming a forwardly and radially inwardly opening recess bounded by a forwardly facing rear wall surface disposed in a transverse plane of said shell and a radially inwardly facing circumferential wall surface and an outwardly projecting circumferential flange at the front end of said recess, a clamp ring coaxially disposed at the front end of said shell, and means joining said shell and clamp ring for urging said shell and clamp ring toward one another, and wherein said shell includes an inner circumferential flange within and disposed in a transverse plane of said shell rearwardly of said shell recess, said clamp ring includes a central cylindrical portion coaxially disposed within the front end of said shell and axially overlapping said recess to form with said rear and circumferential wall surfaces a forwardly opening annular cavity for receiving a seal ring, a radially outwardly projecting circumferential flange about the front end of said clamp ring central portion located forwardly of said shell flange, and radially inwardly projecting circumferential flange means about the inside of said clamp ring central portion, and said means joining said clamp ring and mounting box shell comprise screws extending through said inner clamp ring flange means and said shell inner flange.

15. A mounting box for an aquatic light, comprising:

a one piece, generally cup-like shell having a front end opening and including a circumferential side wall having a front end and a radially outwardly stepped front end portion forming a forwardly and radially inwardly opening circumferential recess about said front end opening bounded by an annular rear wall surface facing forwardly toward said front end of said side wall and a radially inwardly facing generally cylindrical circumferential wall surface extending forwardly from said rear wall surface to said front end of said side wall, and a flange about, integrally joined to, and extending radially outward from said front end of said side wall, a clamp ring having a cylindrical portion coaxially disposed within said front end opening of said mounting box shell and axially overlapping said recess to form an annular, forwardly opening seal ring cavity, and a flange about, integrally joined to, and extending radially outward from said cylindrical portion forwardly of said shell flange, means joining said shell and clamp ring for moving said shell and clamp ring and thereby their flanges toward one another, and wherein said cavity is adapted to contain a seal ring engaging said circumferential surface of said shell recess and said cylindrical portion of said clamp ring.

16. A mounting box according to claim 15 wherein:

said means joining said shell and clamp ring include internal flanges within said shell and clamp ring and screws joining said internal flanges.

17. A watertight lamp structure comprising:

a shell-like lamp housing having a front opening and a circumferential side wall, a transparent lens within said front opening, said housing side wall has a forwardly and radially inwardly opening annular recess about said front opening receiving the perimeter of said lens and bounded by a forwardly facing rear wall surface disposed in a transverse plane of said housing and a radially inwardly facing circumferential wall surface extending forwardly from said rear wall surface to the front end of said housing side wall, said lens has about its perimeter a rearwardly and radially outwardly opening annular recess bounded by an annular front wall surface facing rearwardly toward said housing rear wall surface and a circumferential wall surface facing radially outward toward said housing circumferential wall surface, said wall surfaces form therebetween an annular seal ring cavity, a seal ring within said cavity disposed in fluid seal relation to said circumferential wall surfaces, and a snap ring forwardly of said lens engaging in a groove in said housing circumferential wall for releasibly securing said lens to said housing.

* * * * *